US006020114A

United States Patent [19]

Hagemann

[11] Patent Number: 6,020,114

[45] Date of Patent: Feb. 1, 2000

[54] COLOR PHOTOGRAPHIC RECORDING MATERIAL

[75] Inventor: Jörg Hagemann, Köln, Germany

[73] Assignee: AGFA - Gevaert NV, Mortsel, Belgium

[21] Appl. No.: 08/925,911

[22] Filed: Aug. 21, 1997

[30] Foreign Application Priority Data

Aug. 28, 1996 [DE] Germany ..... 196 34 702

[51] Int. Cl.[7] ..... G03C 7/30

[52] U.S. Cl. ..... 430/504; 430/214; 430/551

[58] Field of Search ..... 430/214, 504, 430/551

[56] References Cited

U.S. PATENT DOCUMENTS

| | | | |
|---|---|---|---|
| 2,728,661 | 12/1955 | Thirtle et al. | 95/6 |
| 4,840,886 | 6/1989 | Iijima et al. | 430/558 |
| 5,356,763 | 10/1994 | Takahashi et al. | 430/505 |
| 5,415,991 | 5/1995 | Kase et al. | 430/600 |
| 5,429,616 | 7/1995 | Ohshima et al. | 430/538 |

FOREIGN PATENT DOCUMENTS

| | | |
|---|---|---|
| 512 496 | 5/1992 | European Pat. Off. . |
| 560 198 | 3/1993 | European Pat. Off. . |
| 178 789 | 9/1995 | European Pat. Off. . |
| 63/85548 | 4/1988 | Japan . |
| 9-68784 | 3/1997 | Japan . |
| 9-152698 | 6/1997 | Japan . |

*Primary Examiner*—Janet Baxter
*Assistant Examiner*—Amanda C. Walke
*Attorney, Agent, or Firm*—Connolly Bove Lodge & Hutz LLP

[57] ABSTRACT

A colour photographic recording material which contains on a support at least one blue-sensitive silver halide emulsion layer, which is associated with a yellow coupler, at least one green-sensitive silver halide emulsion layer, which is associated with a magenta coupler, and at least one red-sensitive silver halide emulsion layer, which is associated with a cyan coupler, together with non-photosensitive interlayers between the layers of different colour sensitivity, characterised in that at least one green-sensitive silver halide emulsion layer contains a pyrazolotriazole coupler as the magenta coupler and at least one interlayer adjacent to this layer contains a compound of the formula I as the DOP scavenger (I)

in which $R_1$ means alkyl, aryl, acyl or alkenyl, $R_2$ means hydrogen or $R_1$ and in which $R_1$ and $R_2$ may also form a ring consisting of 5 or 6 atoms, wherein a ring consisting of 6 atoms is not aromatic, or a compound of the formula II (II)

in which $R_3$ means alkyl, aryl or alkenyl, $R_4$ means hydrogen or $R_3$ and in which $R_3$ and $R_4$ may also form a ring consisting of 5 to 8 atoms, wherein $R_3$ and $R_4$ together have at least 12 C atoms, is distinguished by improved stability to the action of light.

11 Claims, No Drawings

COLOR PHOTOGRAPHIC RECORDING MATERIAL

This invention relates to a colour photographic recording material which contains a pyrazolotriazole coupler in a photosensitive silver halide emulsion layer and a novel developer oxidation product (DOP) scavenger in a non-photosensitive layer adjacent thereto.

It is known to produce coloured photographic images by chromogenic development, i.e., by developing silver halide emulsion layers exposed with an image by means of suitable chromogenic developer substances, so-called colour developers, in the presence of suitable coupler, wherein the oxidation product of the developer substance, which oxidation product is produced congruently with the silver image, reacts with the colour coupler to form a dye image. Aromatic compounds containing primary amino groups, in particular those of p-phenylenediamine type, are normally used as colour developers.

Pyrazolone couplers are conventionally used to produce magenta dye images. The absorption characteristics of the image dyes obtained from these pyrazolone couplers are in many ways not ideal. Particularly disruptive is the yellow secondary density which makes it necessary to use masking couplers or other masking techniques in order to obtain bright colours in the photographic image. It proved possible to achieve a certain improvement in this respect by using 3-anilinopyrazolone couplers. However, colour reproduction still leaves something to be desired.

Pyrazoles condensed with 5-membered heterocyclic compounds, so-called pyrazoloazoles, may also be used as magenta couplers. Their advantage over simple pyrazoles is that they yield colours having greater formalin resistance and purer absorption spectra (EP-A-178 789).

One major problem associated with the use of the frequently used pyrazolotriazole magenta couplers is the low stability of the image dyes obtained to the action of light.

Investigations which have now been performed confirm that this effect is in part caused by the DOP scavengers conventionally used in the non-photosensitive interlayers of a colour photographic material. These compounds are preferably either hydroquinone compounds substituted by 2 long-chain or bulky alkyl groups or by a hydrophobising acylamino residue or disulphoneamidophenols (EP-A-560 198).

The object underlying the invention is to improve the stability of a colour photographic recording material which contains a pyrazolotriazole magenta coupler.

It has now been found that the above-stated object is achieved with a colour photographic recording material according to claim 1.

The present invention accordingly provides a colour photographic recording material which contains on a support at least one blue-sensitive silver halide emulsion layer, which is associated with a yellow coupler, at least one green-sensitive silver halide emulsion layer, which is associated with a magenta coupler, and at least one red-sensitive silver halide emulsion layer, which is associated with a cyan coupler, together with non-photosensitive interlayers between the layers of different colour sensitivity, characterised in that at least one green-sensitive silver halide emulsion layer contains a pyrazolotriazole coupler as the magenta coupler and at least one interlayer adjacent to this layer contains a compound of the formula I as the DOP scavenger (I)

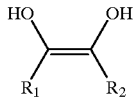

in which $R_1$ means alkyl, aryl, acyl or alkenyl, $R_2$ means hydrogen or $R_1$ and in which $R_1$ and $R_2$ may also form a ring consisting of 5 or 6 atoms, wherein a ring consisting of 6 atoms is not aromatic, or a compound of the formula II (II)

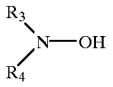

in which $R_3$ means alkyl, aryl or alkenyl, $R_4$ means hydrogen or $R_3$ and in which $R_3$ and $R_4$ may also form a ring consisting of 5 to 8 atoms, wherein $R_3$ and $R_4$ together have at least 12 C atoms.

In a preferred embodiment of the invention, the DOP scavenger of the formula I is of the formula III (III)

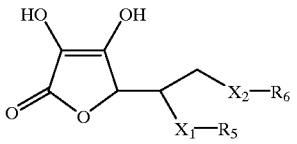

in which $X_1$, $X_2$ mean —O— or —$NR_7$—

$R_5$, $R_6$ mean hydrogen or acyl and $R_7$ means hydrogen, alkyl or acyl.

In a particularly preferred embodiment of the invention $X_1$, $X_2$ mean —O—, $R_5$ means hydrogen and $R_6$ means acyl in the formula III.

An alkyl or alkenyl residue represented by $R_1$, $R_2$, $R_3$, $R_4$ or $R_7$ or contained therein may be linear, branched or cyclic.

A residue represented by $R_1$ to $R_7$ or contained therein may in turn itself be substituted: possible substituents are halogen, hydroxy, alkyl, alkenyl, alkynyl, aryl, acyl, alkoxy, aryloxy, acyloxy, alkylthio, arylthio or acylamino. An acyl residue may be derived from an aliphatic or aromatic carboxylic or sulphonic acid, from carbonic acid, carbamic acid or amidosulphuric acid, a sulphinic, phosphonic or phosphoric acid.

Examples of suitable DOP scavengers of the formulae I and III are stated below.

I-1
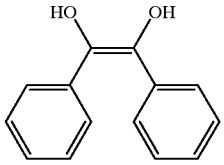
I-2
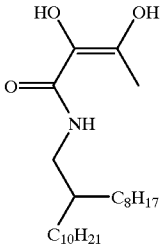
I-3
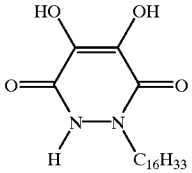
I-4
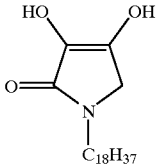
I-5
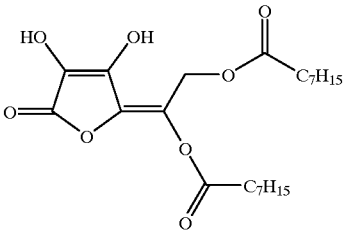
III-1
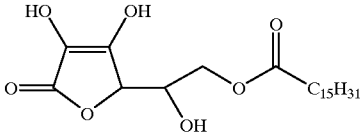
III-2
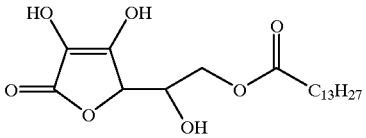
III-3
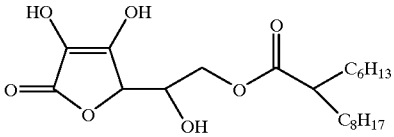
-continued
III-4
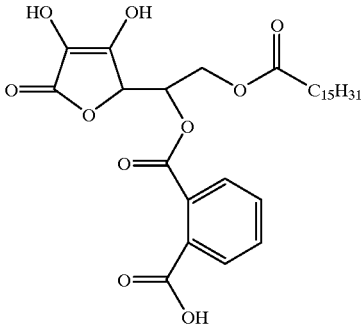
III-5
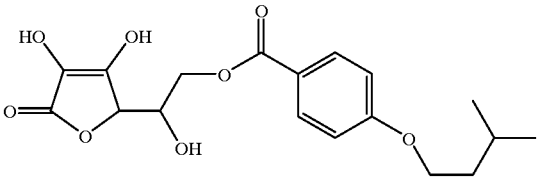
III-6
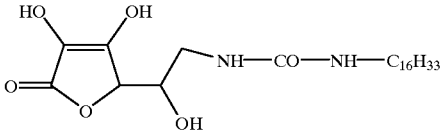
Examples of suitable DOP scavengers of the formula II are stated below.
(II)
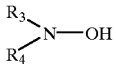
| Nr. | $R_3$ | $R_4$ |
|---|---|---|
| II-1 | $—C_{18}H_{37}$ | H |
| II-2 | $—CH_2—CH(CH_3)—CO_2—C_8H_{17}$ | H |
| II-3 | $—CH_2—CH_2—CO—NH—C_{12}H_{25}$ | H |
| II-4 | $—C_7H_{15}$ | $R_3$ |
| II-5 | $—C_{12}H_{25}$ | $R_3$ |
| II-6 | 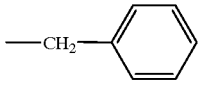 | $R_3$ |
| II-7 | $—CH_2—CH_2—CO_2—CH_2—CH(C_2H_5)C_4H_9$ | $R_3$ |
| II-8 | $—CH_2—CH(CH_3)—CO—NH—C_4H_9$-t | $R_3$ |
| II-9 | 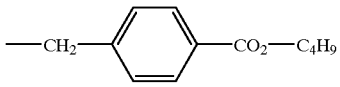 | $R_3$ |
| II-10 | 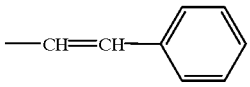 | $R_3$ |
| II-11 | 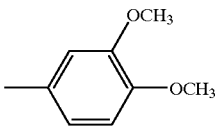 | $R_3$ |

-continued (II)

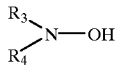

| Nr. | $R_3$ | $R_4$ |
|---|---|---|
| II-12 | 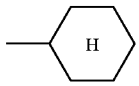 | $R_3$ |
| II-13 | 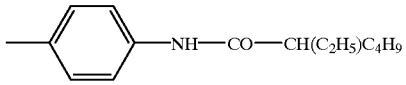 | $R_3$ |
| II-14 | $—C_{18}H_{37}$ | $—CH_3$ |
| II-15 | $—C_{12}H_{25}$ | $—C_2H_5$ |
| II-16 | $—CH_2—CH_2—CO_2—CH_2—CH(C_2H_5)C_4H_9$ | $—C_3H_7$-i |
| II-17 | 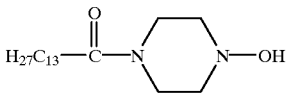 | |
| II-18 | 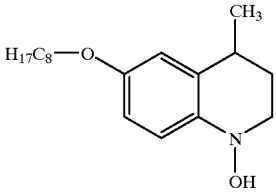 | |
| II-19 | 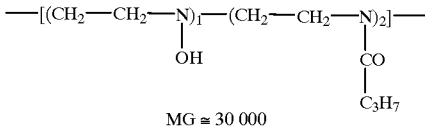 MG ≅ 30 000 | |
| II-20 | 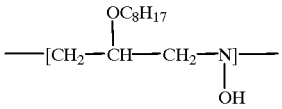 MG ≅ 15 000 | |
| II-21 | 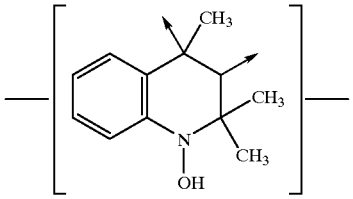 MG ≅ 22 000 | |

The DOP scavengers of the formulae I to III are conventionally used in the colour photographic material in a quantity of 10 to 500 mg/m$^2$ per interlayer. Preferably, 30 to 300 mg/m$^2$ are used.

The pyrazolotriazole magenta couplers are conventionally used in a total quantity of 50 to 800 mg/m$^2$, in particular of 100 to 400 mg/m$^2$.

Preferred pyrazolotriazole couplers are those of the formula IV (IV)

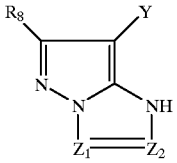

in which $R_8$ means hydrogen, halogen, alkyl, aryl, a heterocyclic group, cyano, alkoxy, acyloxy, carbamoyloxy, acylamino or a polymer residue, Y means hydrogen or a group eliminable under chromogenic development conditions, one of the residues $Z_1$ and $Z_2$ means a nitrogen atom and the other means $—CR_9—$ and $R_9$ has the same meaning as $R_8$, wherein one of the residues $R_8$ and $R_9$ is a ballast group or is substituted by a ballast residue, wherein the ballast group may also be a polymer residue.

In a preferred embodiment,

Y means hydrogen, chlorine, alkyl, aryl, acyl or

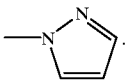

In an another preferred embodiment, $R_8$ and $R_9$ together have at least 15 C atoms.

Examples of suitable pyrazolotriazole couplers of the formula IV are stated below.

M-1
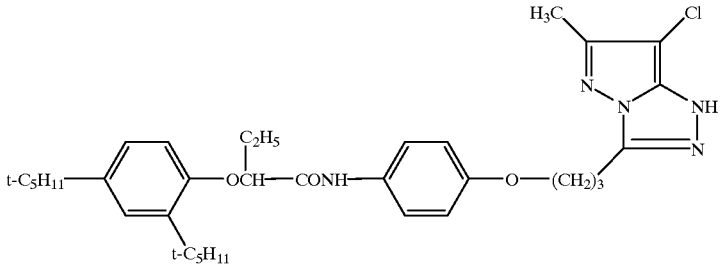
M-2
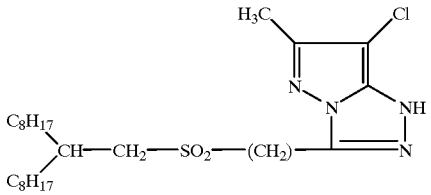
M-3
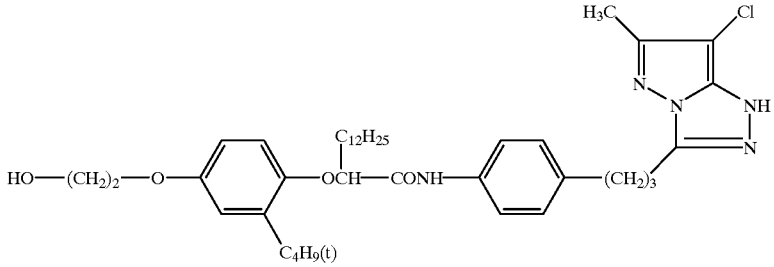
M-4
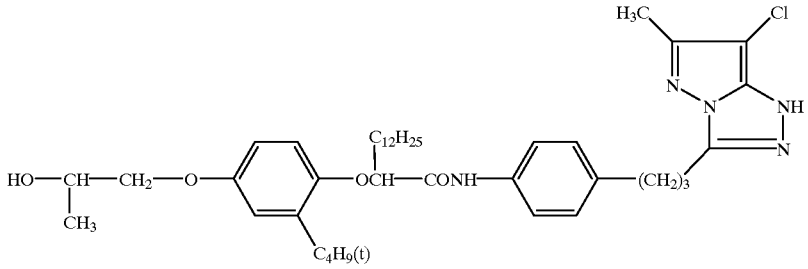
M-5
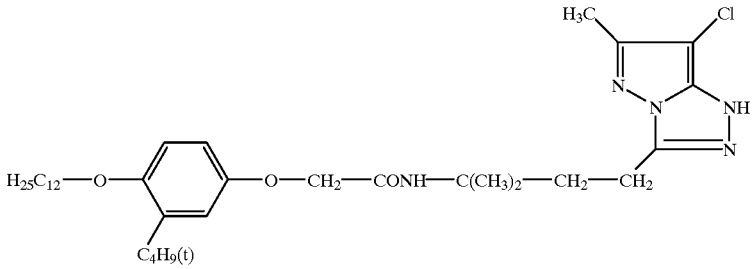
M-6
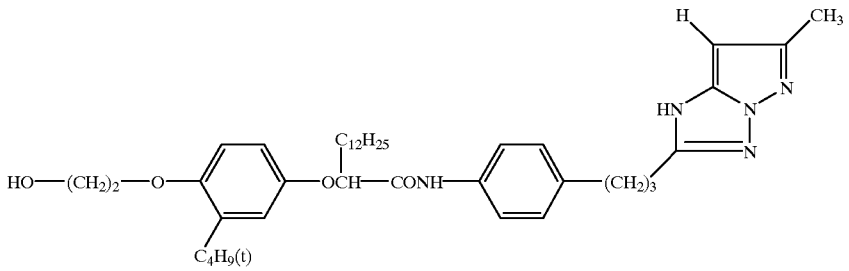

-continued
M-7
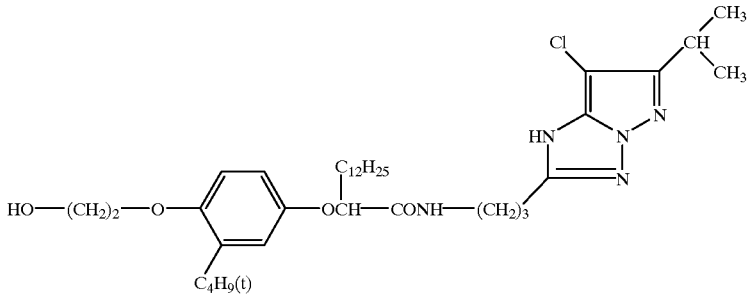
M-8
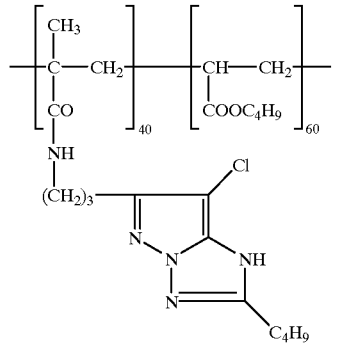
M-9
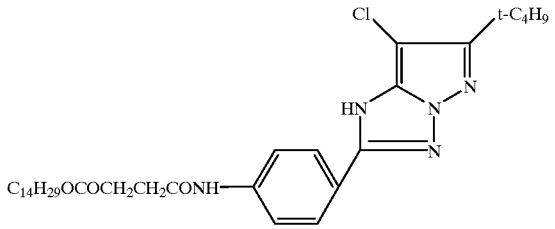
M-10
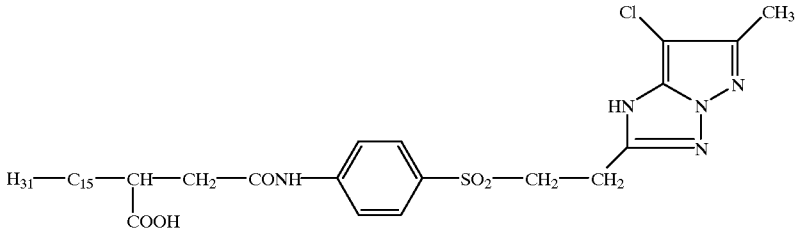
M-11
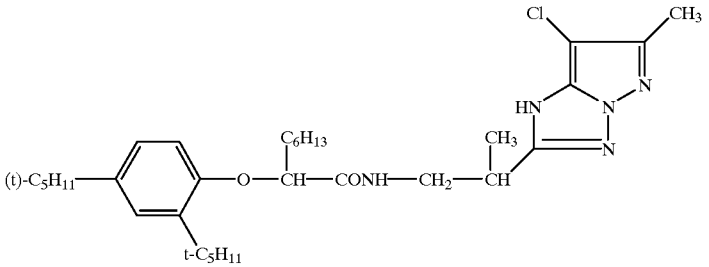

-continued
M-12
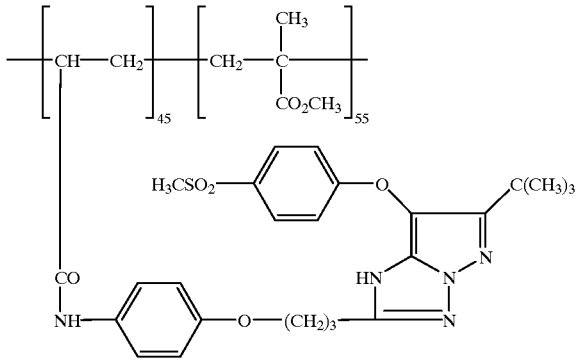
M-13
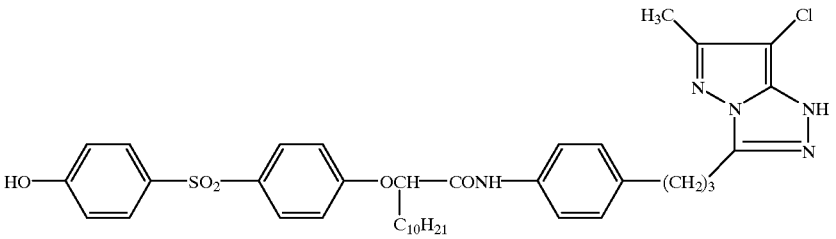
M-14
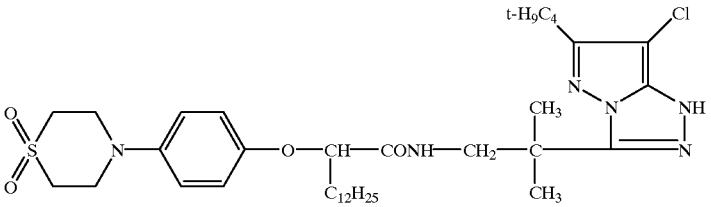
M-15
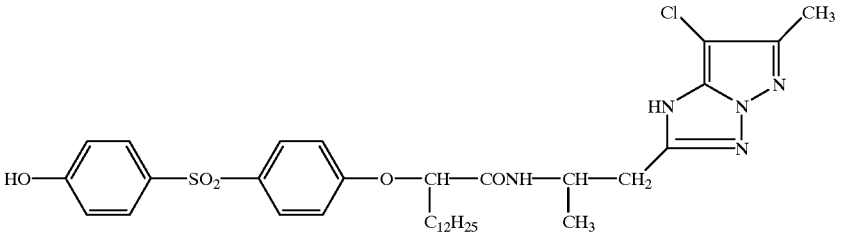
M-16
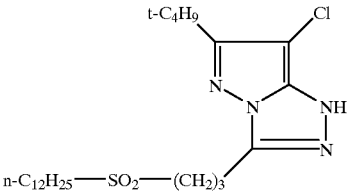
M-17
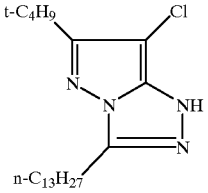

Use of the compounds of the formulae I to IV in photographic materials is known.

U.S. Pat. No. 2,728,661 describes the use of ascorbic acid esters to improve whiteness stability in photosensitive and non-photosensitive layers of a photographic material which does not contain a pyrazolotriazole magenta coupler.

Photographic materials containing pyrazolotriazole magenta couplers and enediols of the formulae I and III (EP-A-512 496, U.S. Pat. No. 5,429,916) or hydroxylamines of the formula II (JP-A-63/85 548) together in a photosensitive silver halide emulsion layer are prior art.

It is, however, completely surprising and not to be learnt from these publications, that using these compounds as DOP scavengers in an interlayer which is adjacent to a green-sensitive silver halide emulsion layer containing a pyrazolotriazole magenta coupler while simultaneously dispensing with the hydroquinones hitherto used for this purpose should result in the above-stated advantages.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The material according to the invention preferably has a reflective support.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

Possible options for different layer arrangements and the effects thereof on photographic properties are described in *J. Inf. Rec. Mats.,* 1994, volume 22, pages 183–193.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 wt. % of AgBr or silver chloride-bromide emulsions with above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, antioxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLE 1

A colour photographic recording material was produced by applying the following layers in the stated sequence onto a film support made of paper coated on both sides with polyethylene. All quantities are stated per 1 $m^2$. The quantity of silver halide applied is stated as the corresponding quantity of $AgNO_3$.

| Layer structure 1 | |
|---|---|
| Layer 1: | (Substrate layer) |
| | 0.2 g of gelatine |
| Layer 2: | (Blue-sensitive layer) |
| | Blue-sensitive silver halide emulsion (99.5 mol. % chloride, 0.5 mol. % bromide, average grain diameter 0.8 $\mu$m) prepared from |
| | 0.45 g of $AgNO_3$ with |
| | 1.18 g of gelatine |
| | 0.55 g of yellow coupler Y-1 |
| | 0.1 g of white coupler W-1 |
| | 0.2 g of dye stabiliser ST-1 |
| | 0.29 g of oil former OF-1 |
| | 0.10 g of oil former OF-2 |
| Layer 3: | (Protective layer) |
| | 1.10 g of gelatine |
| | 0.14 g of compound SC-1 |
| | 0.07 g of tricresyl phosphate (TCP) |

-continued

| Layer structure 1 | |
|---|---|
| Layer 4: | (Green-sensitive layer) |
| | Green-sensitised silver halide emulsion (99.5 mol. % chloride, 0.5 mol. % bromide, average grain diameter 0.6 $\mu$m) prepared from |
| | 0.30 g of $AgNO_3$ with |
| | 1.08 g of gelatine |
| | 0.28 g of magenta coupler M-17 |
| | 0.24 g of dye stabiliser ST-2 |
| | 0.10 g of dye stabiliser ST-3 |
| | 0.25 g of dibutyl adipate |
| | 0.25 g of isooctadecanol |
| Layer 5: | (UV protective layer) |
| | 1.15 g of gelatine |
| | 0.2 g of UV absorber UV-1 |
| | 0.2 g of UV absorber UV-2 |
| | 0.2 g of oil former OF-3 |
| | 0.14 g of compound SC-1 |
| | 0.04 g of TCP |
| Layer 6: | (Red-sensitive layer) |
| | Red-sensitised silver halide emulsion (99.5 mol. % chloride, 0.5 mol. % bromide, average grain diameter 0.5 $\mu$m) prepared from |
| | 0.30 g of $AgNO_3$ with |
| | 0.75 g of gelatine |
| | 0.2 g of UV absorber UV-1 |
| | 0.36 g of cyan coupler C-1 |
| | 0.12 g of dye stabiliser ST-4 |
| | 0.24 g of TCP |
| Layer 7: | (UV protective layer) |
| | 0.35 g of gelatine |
| | 0.15 g of UV absorber UV-3 |
| | 0.15 g of oil former OF-4 |
| Layer 8: | (Protective layer) |
| | 0.9 g of gelatine |
| | 0.3 g of hardener H-1 |

The following compounds were used in the layer structure of Example 1:

Y-1

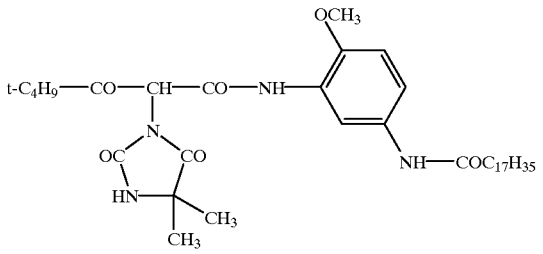

C-1

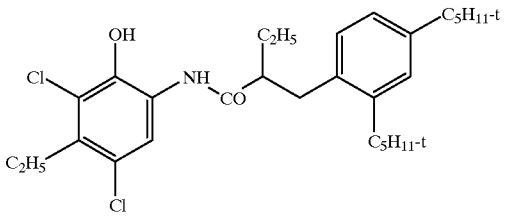

-continued
W-1
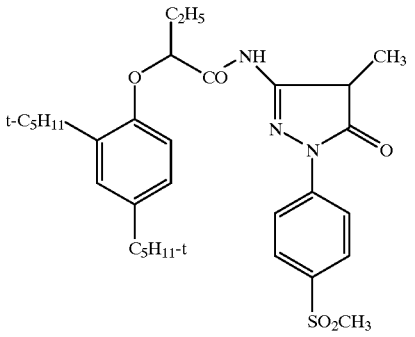
ST-1
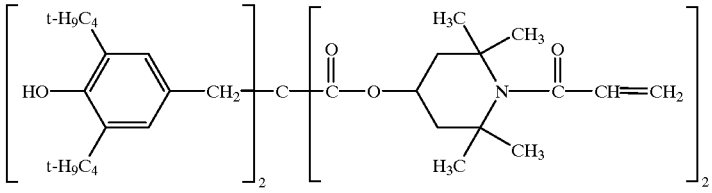
ST-2
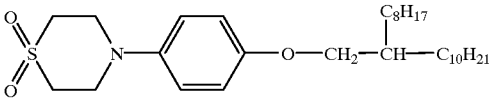
ST-3
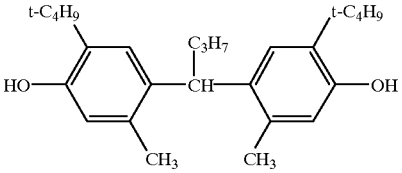
ST-4
1:2 mixture of
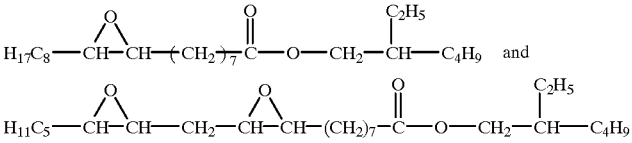
ST-5
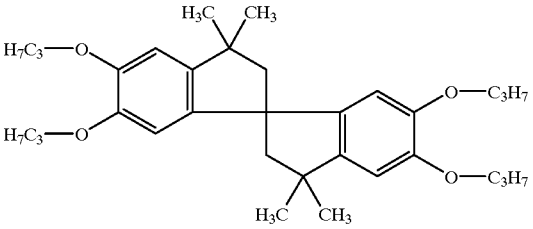
OF-1
Adipic acid polyester with 1, 3-butanediol and 1, 4-butanediol
OF-2
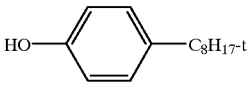
OF-3
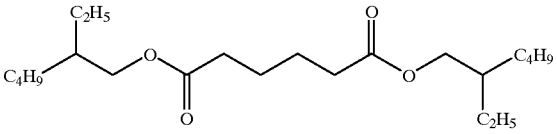

-continued
OF-4
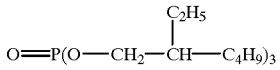
SC-1
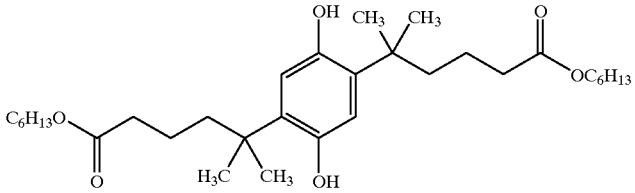
SC-2
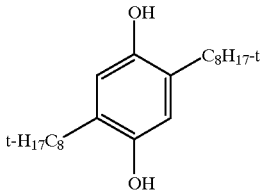
SC-3
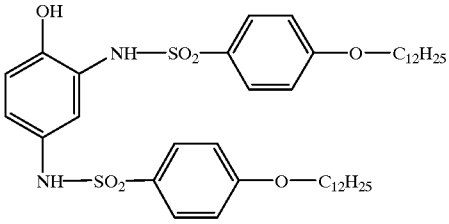
UV-1
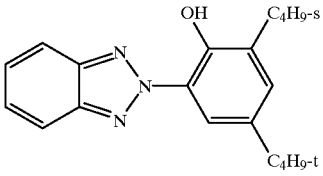
UV-2
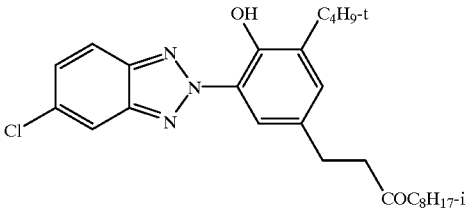
UV-3
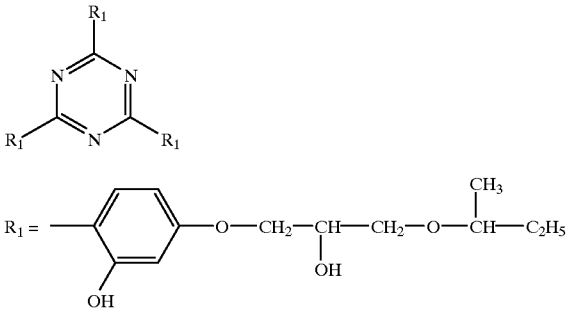

-continued

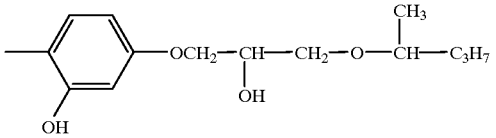

(1:1 mixture)

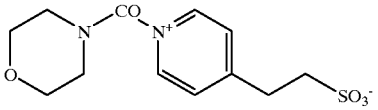

H-1

Layer Structures 2 to 11

In layer structures 2 to 11, compound SC-1 in layers 3 and 5 was replaced by the compounds stated in Table 1. As for SC-1, the quantity used in each case was 0.14 g/m$^2$. Moreover, in layer 4 of layer structures 9 to 11, the magenta coupler M-17 was replaced by 0.18 g/m$^2$ of M-9 and dye stabilisers ST-2 and ST-3 were replaced by 0.6 g/m$^2$ of ST-5.

Layer Structures 12 and 13

Layer structures 12 and 13 are also identical to layer structure 1, with the exception that 0.14 g/m$^2$ of III-1 was added to layer 4. In structure 13, compound SC-1 in layers 3 and 5 was additionally omitted.

The specimens were exposed with green light through a graduated grey wedge and then processed as follows:

| | | |
|---|---|---|
| a) | Colour developer - 45 s - 35° C. | |
| | Tetraethylene glycol | 20.0 g |
| | N,N-diethylhydroxylamine | 4.0 g |
| | (N-ethyl-N-(2-methanesulphonamido)ethyl))-4-amino-3-methylbenzene sulphate | 5.0 g |
| | Potassium sulphite | 0.2 g |
| | Potassium carbonate | 30.0 g |
| | Polymaleic anhydride | 2.5 g |
| | Hydroxyethanediphosphonic acid | 0.2 g |
| | Optical whitener (4,4'-diaminostilbene sulphonic acid derivative) | 2.0 g |
| | Potassium bromide | 0.02 g |
| | make up with water to 1000 ml; adjust pH value to pH = 10.2 with KOH or $H_2SO_4$. | |
| b) | Bleach/fixing bath - 45 s - 35° C. | |
| | Ammonium thiosulphate | 75.0 g |
| | Sodium hydrogen sulphite | 13.5 g |
| | Ethylenediaminetetraacetic acid (iron-ammonium salt) | 45.0 g |
| | make up with water to 1000 ml; adjust pH value to pH 6.0 with ammonia (25%) or acetic acid. | |
| c) | Rinsing - 2 min - 33° C. | |
| d) | Drying | |

Cyan density ($D_{cyan}$) at magenta density ($D_{magenta}$) 1.0 and magenta fog ($D_{min}$(magenta)) were then measured (Table 1). The specimens were then exposed to the light from a daylight-standardised xenon lamp and irradiated with 15–10$^6$ lxh. The percentage reduction in density $\Delta D_{magenta}$ after irradiation was determined at initial density $D_{magenta}$= 1.0

TABLE 1

| Layer structure | DOP scavenger in layers 3 and 5 | $D_{min}$ (magenta) | $D_{cyan}$ at $D_{magenta}$ = 1.0 | $\Delta D_{magenta}$ in % | |
|---|---|---|---|---|---|
| 1 | SC-1 | 0.08 | 0.118 | −33 | Comparison |
| 2 | — | 0.09 | 0.152 | −26 | Comparison |
| 3 | SC-2 | 0.08 | 0.109 | −40 | Comparison |
| 4 | SC-3 | 0.08 | 0.123 | −28 | Comparison |
| 5 | III-1 | 0.08 | 0.104 | −24 | Invention |
| 6 | III-3 | 0.08 | 0.105 | −24 | Invention |
| 7 | I-1 | 0.08 | 0.110 | −27 | Invention |
| 8 | I-4 | 0.08 | 0.108 | −25 | Invention |
| 9 | SC-2 | 0.07 | 0.089 | −27 | Comparison |
| 10 | III-1 | 0.07 | 0.086 | −15 | Invention |
| 11 | III-6 | 0.07 | 0.088 | −14 | Invention |
| 12 | SC-1 | 0.23 | 0.115 | −36 | Comparison |
| 13 | — | 0.25 | 0.149 | −35 | Comparison |

As may be seen, the specimens according to the invention exhibit the greatest possible magenta dye stability and only very slight co-coupling of the red-sensitive layer.

Table 1 moreover demonstrates that adding the compound III-1 according to the invention to the green-sensitive silver halide emulsion layer (layer structures 12 and 13, prior art according to U.S. Pat. No. 5,429,916), neither effectively prevents co-coupling nor improves magenta dye stability. There is, moreover, an appreciable rise in magenta fog.

EXAMPLE 2

A colour photographic recording material was produced by applying the following layers in the stated sequence onto a film support made of paper coated on both sides with polyethylene. All quantities are stated per 1 m$^2$. The quantity of silver halide applied is stated as the corresponding quantity of $AgNO_3$.

| Layer structure 14 | |
|---|---|
| Layer 1: | as layer structure 1 |
| Layer 2: | (Blue-sensitive layer) |
| | Blue-sensitive silver halide emulsion (99.5 mol. % chloride, 0.5 mol. % bromide, average grain diameter 0.8 μm) prepared from |
| | 0.45 g of $AgNO_3$ with |
| | 1.18 g of gelatine |
| | 0.55 g of yellow coupler Y-2 |
| | 0.1 g of white coupler W-1 |
| | 0.2 g of dye stabiliser ST-1 |
| | 0.29 g of oil former OF-5 |
| | 0.10 g of oil former OF-2 |

-continued

| Layer structure 14 | |
|---|---|
| Layer 3: | as layer structure 1 |
| Layer 4: | (Green-sensitive layer) |
| | Green-sensitised silver halide emulsion (99.5 mol. % chloride, 0.5 mol. % bromide, average grain diameter 0.6 μm) prepared from<br>0.30 g of $AgNO_3$ with<br>1.08 g of gelatine<br>0.28 g of magenta coupler M-16<br>0.24 g of dye stabiliser ST-2<br>0.10 g of dye stabiliser ST-6<br>0.50 g of diisooctyl phthalate |
| Layer 5: | as layer structure 1 |
| Layer 6: | (Red-sensitive layer) |
| | Red-sensitised silver halide emulsion (99.5 mol. % chloride, 0.5 mol. % bromide, average grain diameter 0.5 μm) prepared from<br>0.30 g of $AgNO_3$ with<br>0.75 g of gelatine<br>0.2 g of UV absorber UV-1<br>0.36 g of cyan coupler C-2<br>0.12 g of dye stabiliser ST-4<br>0.24 g of TCP |
| Layer 7: | (UV protective layer) |
| | 0.35 g of gelatine<br>0.15 g of UV absorber UV-4<br>0.15 g of oil former OF-4 |
| Layer 8: | as layer structure 1 |

The following new compounds were used in the layer structure of Example 2:

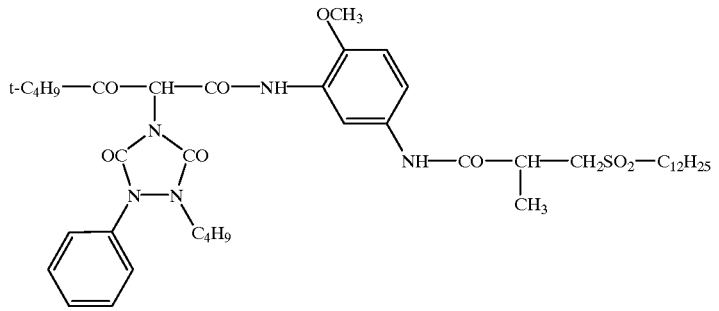

OF-5 Adipic acid polyester with 1,3-butanediol and 1,6-hexanediol C-1 1:1 mixture of

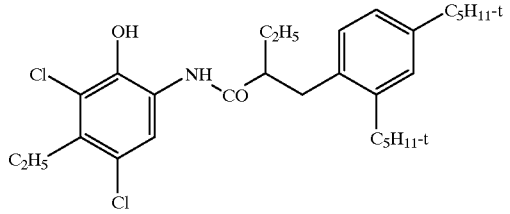

and

-continued

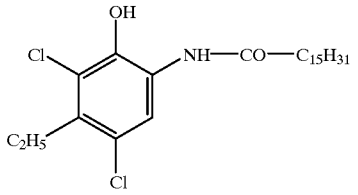

ST-6

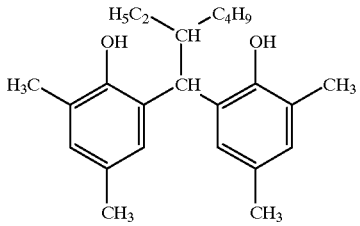

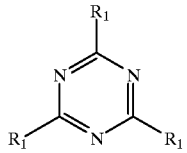

UV-4

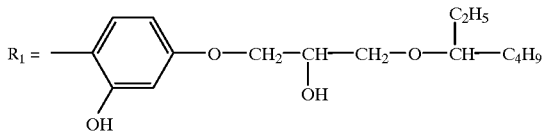

Layer Structures 15 to 24

Y-2

In layer structures 15 to 24, compound SC-1 in layers 3 and 5 was replaced by the compounds stated in Table 2. As for SC-1, the quantity used in each case was 0.14 g/m$^2$. Moreover, in layer 4 of layer structures 22 to 24, the magenta coupler M-16 was replaced by 0.18 g/m$^2$ of M-9 and dye stabilisers ST-2 and ST-6 were replaced by 0.6 g/m$^2$ of ST-5.

Layer Structures 25 to 27

Layer structures 25 to 27 are also identical to layer structure 14, with the exception that 0.14 g/m$^2$ of II-5 (structures 25 and 26) or II-6 (structure 27) was added to layer 4. In structures 26 and 27, compound SC-1 in layers 3 and 5 was additionally omitted.

The specimens were exposed with green light through a graduated grey wedge and then processed as in Example 1.

Cyan density ($D_{cyan}$) at magenta density ($D_{magenta}$) 1.0 and magenta fog ($D_{min}$(magenta)) were then measured (Table 2). The specimens were then exposed to the light from a daylight-standardised xenon lamp and irradiated with $20-10^6$ l×h. The percentage reduction in density $\Delta D_{magenta}$ after irradiation was determined at initial density $D_{magenta}$= 1.0.

TABLE 2

| Layer structure | DOP scavenger in layers 3 and 5 | $D_{min}$ (magenta) | $D_{cyan}$ at $D_{magenta}$ = 1.0 | $\Delta D_{magenta}$ in % | |
|---|---|---|---|---|---|
| 14 | SC-1 | 0.08 | 0.121 | −40 | Comparison |
| 15 | — | 0.09 | 0.158 | −32 | Comparison |
| 16 | SC-2 | 0.08 | 0.112 | −47 | Comparison |
| 17 | SC-3 | 0.08 | 0.126 | −33 | Comparison |
| 18 | II-2 | 0.08 | 0.110 | −31 | Invention |
| 19 | II-6 | 0.08 | 0.113 | −32 | Invention |
| 20 | II-7 | 0.08 | 0.111 | −31 | Invention |
| 21 | II-17 | 0.08 | 0.111 | −33 | Invention |
| 22 | SC-2 | 0.07 | 0.091 | −32 | Comparison |
| 23 | II-16 | 0.07 | 0.090 | −20 | Invention |
| 24 | II-20 | 0.07 | 0.092 | −21 | Invention |
| 25 | SC-1 | 0.27 | 0.123 | −45 | Comparison |
| 26 | — | 0.29 | 0.154 | −44 | Comparison |
| 27 | — | 0.28 | 0.150 | −47 | Comparison |

As may be seen, the specimens according to the invention exhibit the greatest possible magenta dye stability and only very slight co-coupling of the red-sensitive layer.

Table 2 moreover demonstrates that adding the compounds II-5 or II-6 according to the invention to the green-sensitive silver halide emulsion layer (layer structures 25 to 27, prior art according to JP-A-63/85 548), neither effectively prevents co-coupling nor improves magenta dye stability. There is, moreover, an appreciable rise in magenta fog.

I claim:

1. A color photographic recording material which comprises on a support at least one blue-sensitive silver halide emulsion layer, which is associated with a yellow coupler, at least one green-sensitive silver halide emulsion layer, which is associated with a magenta coupler, and at least one red-sensitive silver halide emulsion layer, which is associated with a cyan coupler, together with non-photosensitive interlayers between the layers of different color sensitivity, wherein at least one green-sensitive silver halide emulsion layer contains a pyrazolotriazole coupler as the magenta coupler and at least one interlayer adjacent to this layer contains a compound of the formula II (II)

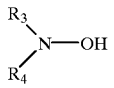

in which $R_3$ is alkyl, aryl or alkenyl, $R_4$ is hydrogen, alkyl, aryl or alkenyl, and wherein $R_3$ and $R_4$ together have at least 12 C atoms or $R_3$ and $R_4$ form a ring consisting of 5 to 8 atoms.

2. The color photographic recording material according to claim 1, wherein the pyrazolotriazole coupler is of the formula IV (IV)

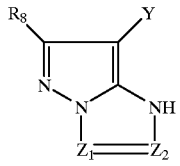

in which $R_8$ is hydrogen, halogen, alkyl, aryl, a heterocyclic group, cyano, alkoxy, acyloxy, carbamoyloxy, acylamino or a polymer residue, Y is hydrogen or a group eliminable under chromogenic development conditions, one of the residues $Z_1$ and $Z_2$ is a nitrogen atom and the other is —$CR_9$— and $R_9$ has the same meaning as $R_8$, wherein one of the residues $R_8$ and $R_9$ is a ballast group or is substituted by a ballast residue, wherein the ballast group optionally is a polymer residue.

3. The color photographic recording material according to claim 1, wherein the pyrazolotriazole coupler is used in the photographic material in a quantity of 50 to 800 mg/m$^2$ per interlayer.

4. The color photographic recording material according to claim 1, wherein $R_3$ and $R_4$ are identical.

5. The color photographic recording material according to claim 1, wherein the compound of the formula II is used in the photographic material in a quantity of 10 to 500 mg/m$^2$ per interlayer.

6. The color photographic recording material according to claim 2, wherein the pyrazolotriazole coupler is used in the photographic material in a quantity of 50 to 800 mg/m$^2$.

7. The color photographic recording material according to claim 2, wherein Y is hydrogen, chlorine, alkyl, aryl, acyl or

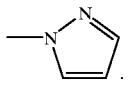

.

8. The color photographic recording material according to claim 2, wherein the pyrazolotriazole coupler of formula VI is selected from the group consisting of

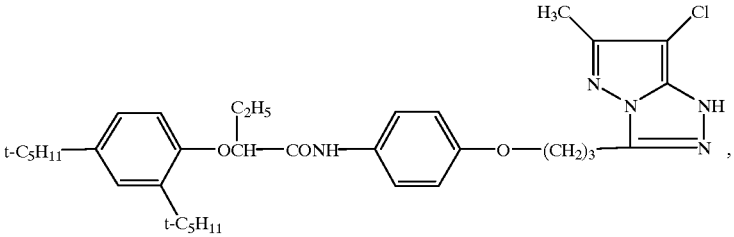

,

-continued
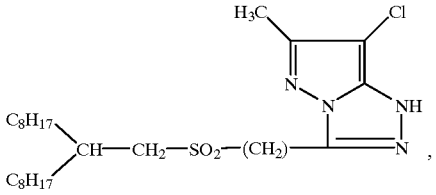
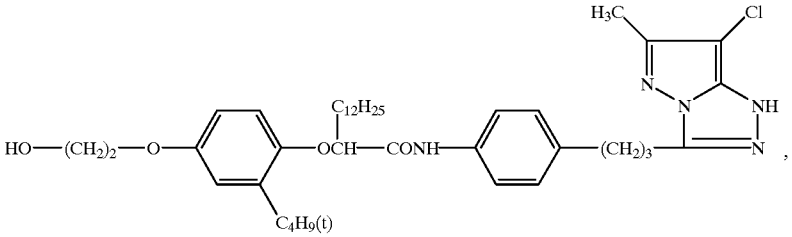
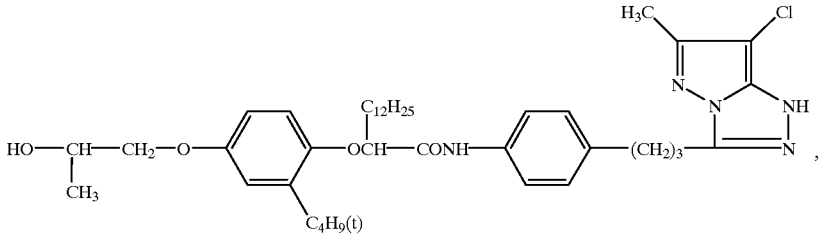
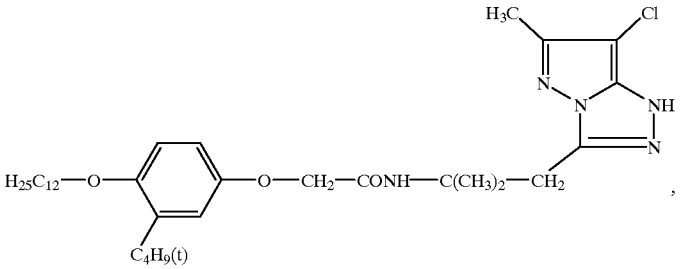
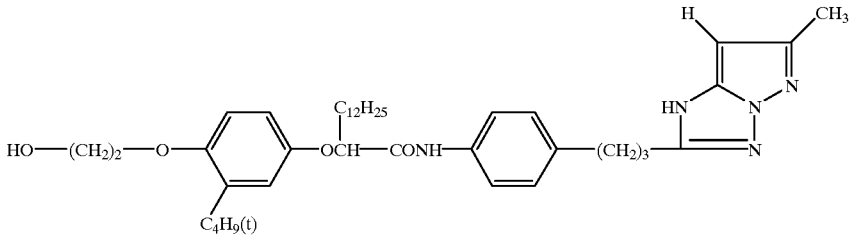
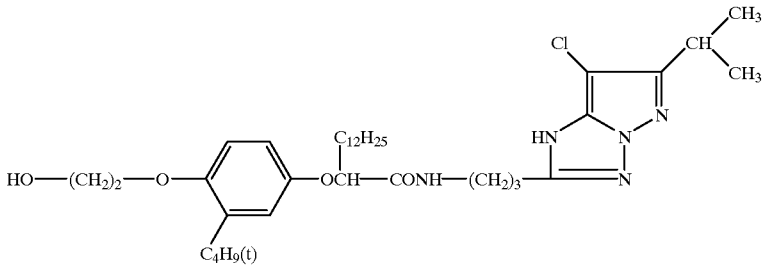

-continued
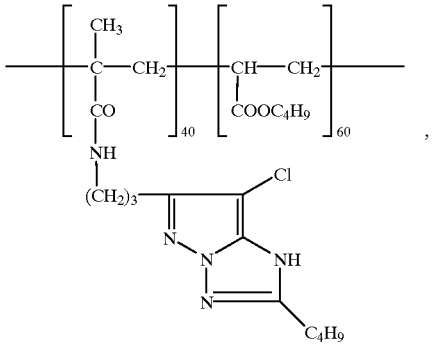
,
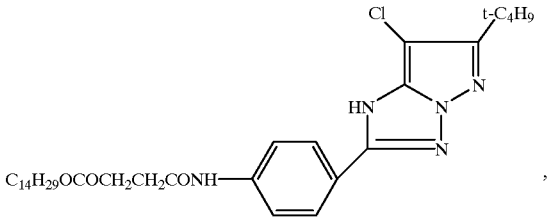
,
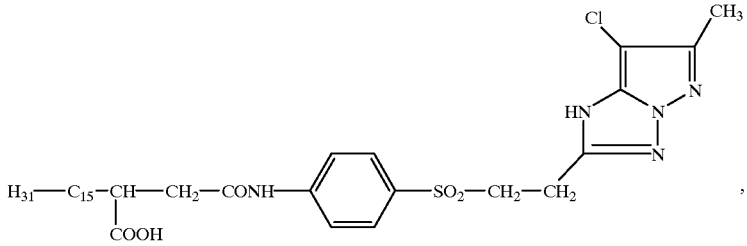
,
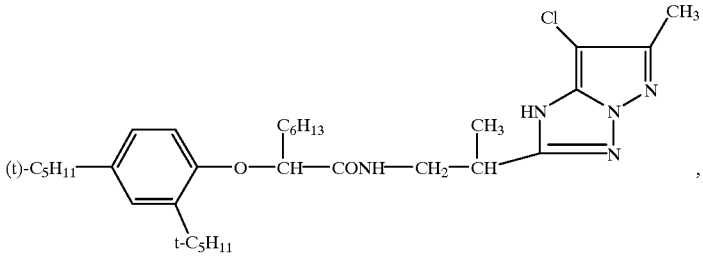
,
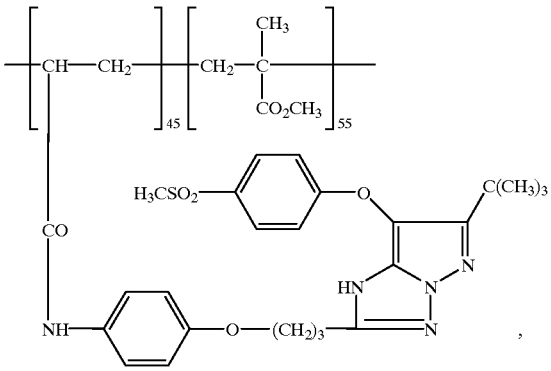
,

-continued

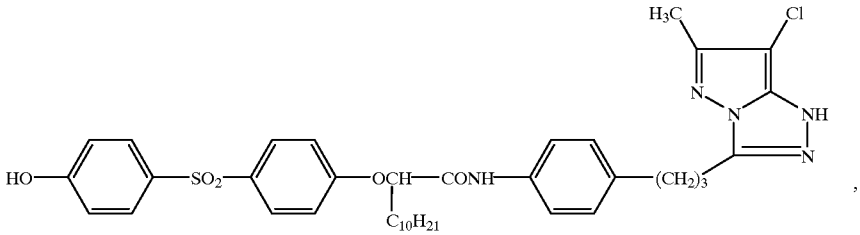

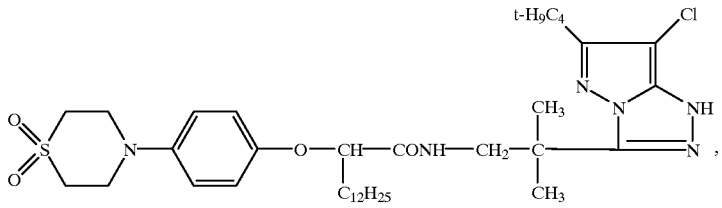

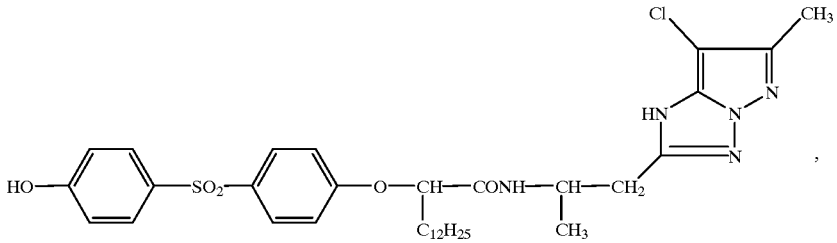

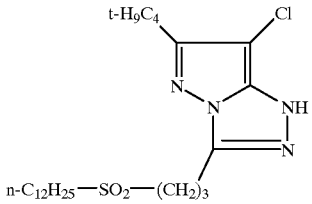

and

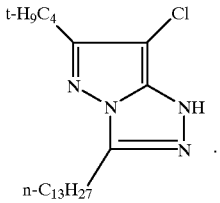

9. The color photographic recording material according to claim 3, wherein the compound of formula II is used in the photographic material in a quantity of 30 to 300 mg/m$^2$ per interlayer.

10. The color photographic recording material according to claim 6, wherein the pyrazolotriazole coupler is used in the photographic material in a quantity of 100 to 400 mg/m$^2$.

11. The color photographic recording material according to claim 10, wherein $R_8$ and $R_9$ together have at least 15 carbon atoms.

* * * * *